US005788165A

United States Patent [19]

Sakakibara et al.

[11] Patent Number: 5,788,165

[45] Date of Patent: Aug. 4, 1998

[54] ROTARY ATOMIZING HEAD OF A ROTARY ATOMIZING ELECTROSTATIC COATING APPARATUS

[75] Inventors: Masahito Sakakibara, Okazaki; Yoshiaki Ohnishi, Toyota; Yasuo Ishiguro, Nagyoa, all of Japan

[73] Assignee: Toyota Jidosha Kabushiki Kaisha, Aichi-ken, Japan

[21] Appl. No.: 800,389

[22] Filed: Feb. 14, 1997

[30] Foreign Application Priority Data

Feb. 16, 1996 [JP] Japan ..... 8-029648

[51] Int. Cl.[6] ..... B05B 5/04

[52] U.S. Cl. ..... 239/700; 239/223

[58] Field of Search ..... 239/700–703, 239/223, 224, 3

[56] References Cited

U.S. PATENT DOCUMENTS 2,989,241 6/1961 Badger et al. .

3,009,441 11/1961 Juonall ..... 239/703 X 4,785,995 11/1988 Yamane et al. .

5,358,182 10/1994 Cappeau et al. ..... 239/703

FOREIGN PATENT DOCUMENTS 0600397 6/1994 European Pat. Off. .

62-286566 12/1987 Japan .

362945 3/1960 Switzerland ..... 239/700

*Primary Examiner*—Kevin Weldon

*Attorney, Agent, or Firm*—Cushman Darby Cushman IP Group of Pillsbury Madison & Sutro LLP

[57] ABSTRACT

A bell head of a rotary atomizing electrostatic coating apparatus includes a bell head body made from high electric resistance material, a semi-conductive layer formed on an outside surface of the bell head body, and a high electric resistance layer formed on an outside surface of the semi-conductive layer. The high electric resistance layer is also of a chemical-proof and of a thinner-proof type.

14 Claims, 4 Drawing Sheets

ROTARY ATOMIZING HEAD OF A ROTARY ATOMIZING ELECTROSTATIC COATING APPARATUS

This application is based on Japanese Patent Application No. HEI 8-29648 filed in Japan on Feb. 16, 1996, the content of which is incorporated into the present application by reference.

BACKGROUND OF THE INVENTION

1. Field of the Invention

The present invention relates to a bell head (or a rotary atomizing head) of a rotary atomizing electrostatic coating apparatus, to which a high voltage is imposed during coating.

2. Description of Related Art

In a conventional rotary atomizing electrostatic coating apparatus, a bell head is driven at a high speed by an air motor including an air bearing. Paint is supplied to the bell head and is atomized. To raise painting efficiency, static electricity is imposed on the bell head, so that paint is electrically charged from the bell head during coating.

Usually, members of a rotary atomizing electrostatic coating apparatus are made from electrically conductive materials of, usually, light metals. Therefore, when static electricity is imposed on the apparatus, a considerably large quantity of electrostatic energy is charged on the apparatus. As a result, when some electrically grounded article approaches the coating apparatus or the coating apparatus approaches the electrically grounded article, an electric spark is caused between the coating apparatus and the grounded article.

More particularly, when coating is conducted within a car body, the coating apparatus inevitably approaches the grounded car body. To prevent a spark from occurring, conventionally, such a bell head as illustrated in FIG. 4 is used. The bell head includes a main body 1' made from synthetic resin (of a high electric resistance) and a semi-conductive layer formed by coating semi-conductive paint 2' (disclosed in Japanese Patent Publication No. SHO 62-286566) on an outside surface of the body. With this structure, static electricity is transmitted from a high voltage electricity generator through a rotary shaft to the semi-conductive coating layer which contacts the rotary shaft.

However, the above-described type bell head having the coating layer of semi-conductive material 2' formed on the bell head body 1' of a high electric resistance has the problem that it is difficult to maintain its electric resistance at a semi-conductive level throughout the entire outside surface of the bell head. This is because, as illustrated in FIG. 5, particles of carbon contained in the semi-conductive material 2' (made from a mixture of particles of carbon and resin such as phenol) and flakes of aluminum contained in the metallic paint cooperate to form an electric resistance line to thereby change the electric resistance of the coating layer. Further, because a thickness and/or composition of the coating layer changes due to corrosion by chemicals or thinner from outside, the electric resistance of the coating layer changes. In this instance, if the electric resistance of the coating layer changes to be too low, an electric spark will be caused, and if the electric resistance of the coating layer changes to be too high, imposition of static electricity through the bell head onto the paint will become impossible, resulting in a decrease in the painting efficiency.

SUMMARY OF THE INVENTION

An object of the present invention is to provide a bell head of a rotary atomizing electrostatic coating apparatus which can prevent an electric resistance of a semi-conductive layer of the bell head from being changed.

The above-described object is achieved by providing a bell head of a rotary atomizing electrostatic coating apparatus according to the present invention which includes a main body formed from high electric resistance material, a semi-conductive layer formed on an outside surface of the main body, and a high electric resistance layer formed on the outside surface of the semi-conductive layer. The outermost high electric resistance layer is resistant to chemicals, particularly thinners.

Since the above-described bell according to the present invention has the outermost high electric resistance layer, no electric resistance line is formed between the semi-conductive layer and a metallic paint, so that even when the metallic paint contacts the bell head, no change is caused in the electric resistance of the conductive layer. Further, since the semi-conductive layer is isolated from thinner and chemicals by the outermost layer, no change due to corrosion is caused in the electric resistance of the semi-conductive layer.

BRIEF DESCRIPTION OF THE DRAWINGS

The above and other objects, features, and advantages of the present invention will become more apparent and will be more readily appreciated from the following detailed description of the preferred embodiments of the present invention in conjunction with the accompanying drawings, in which.

DETAILED DESCRIPTION OF THE PREFERRED EMBODIMENTS

A bell head of a rotary atomizing electrostatic coating apparatus according to one embodiment of the present invention will be explained with reference to FIGS. 1–3.

Figure 2:
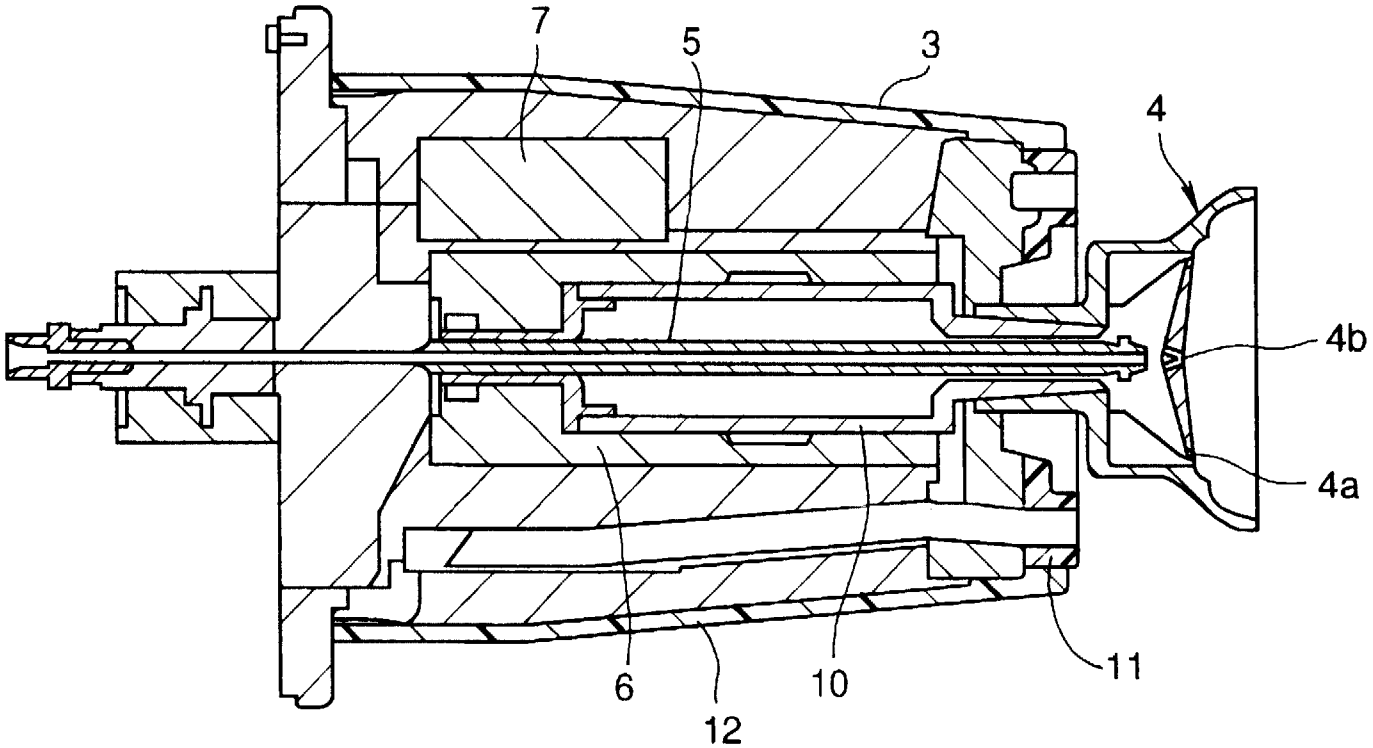
FIG. 2 is a cross-sectional view of a rotary atomizing electrostatic coating apparatus mounting the bell head of FIG. 1.
Figure 3:
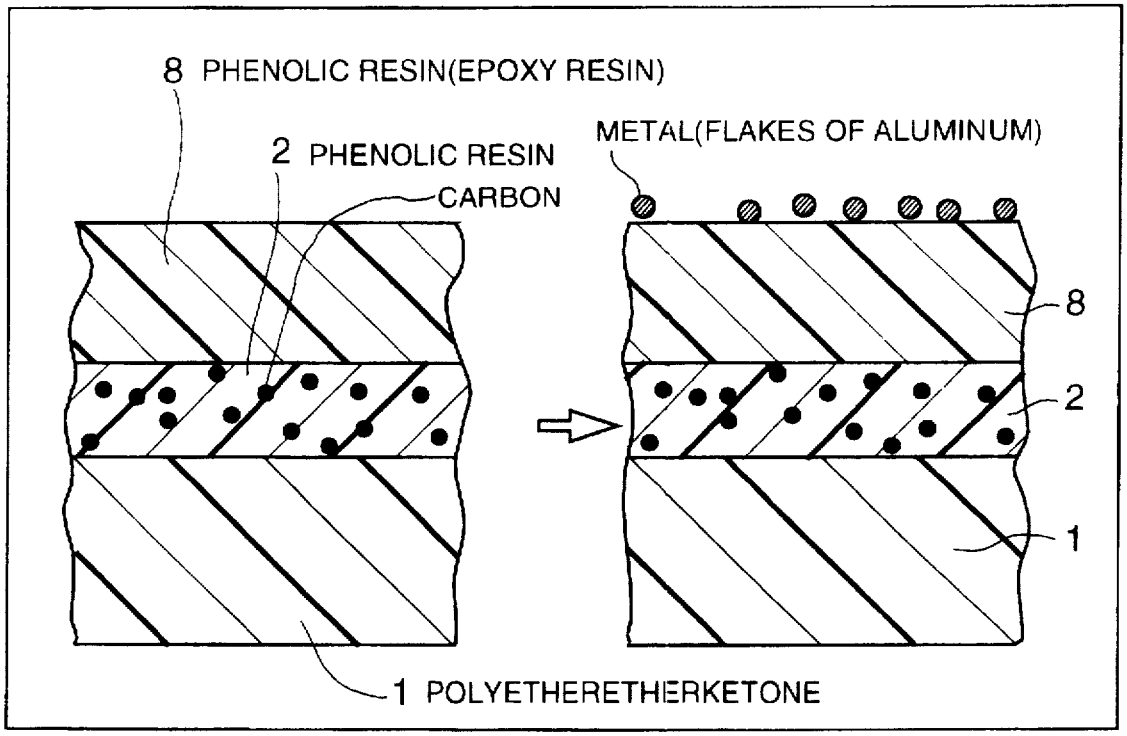
FIG. 3 is an enlarged cross-sectional view of a portion of the bell head of FIG. 1 illustrating a principle of suppressing a change in an electric resistance of the bell head of FIG. 1.
Figure 4:
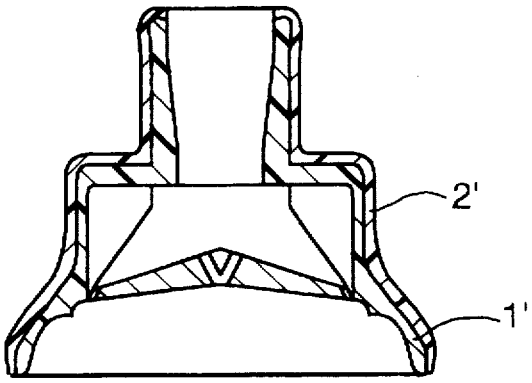
FIG. 4 (PRIOR ART)
FIG. 4 is a cross-sectional view of a bell head of a conventional rotary atomizing electrostatic coating apparatus.
Figure 5:
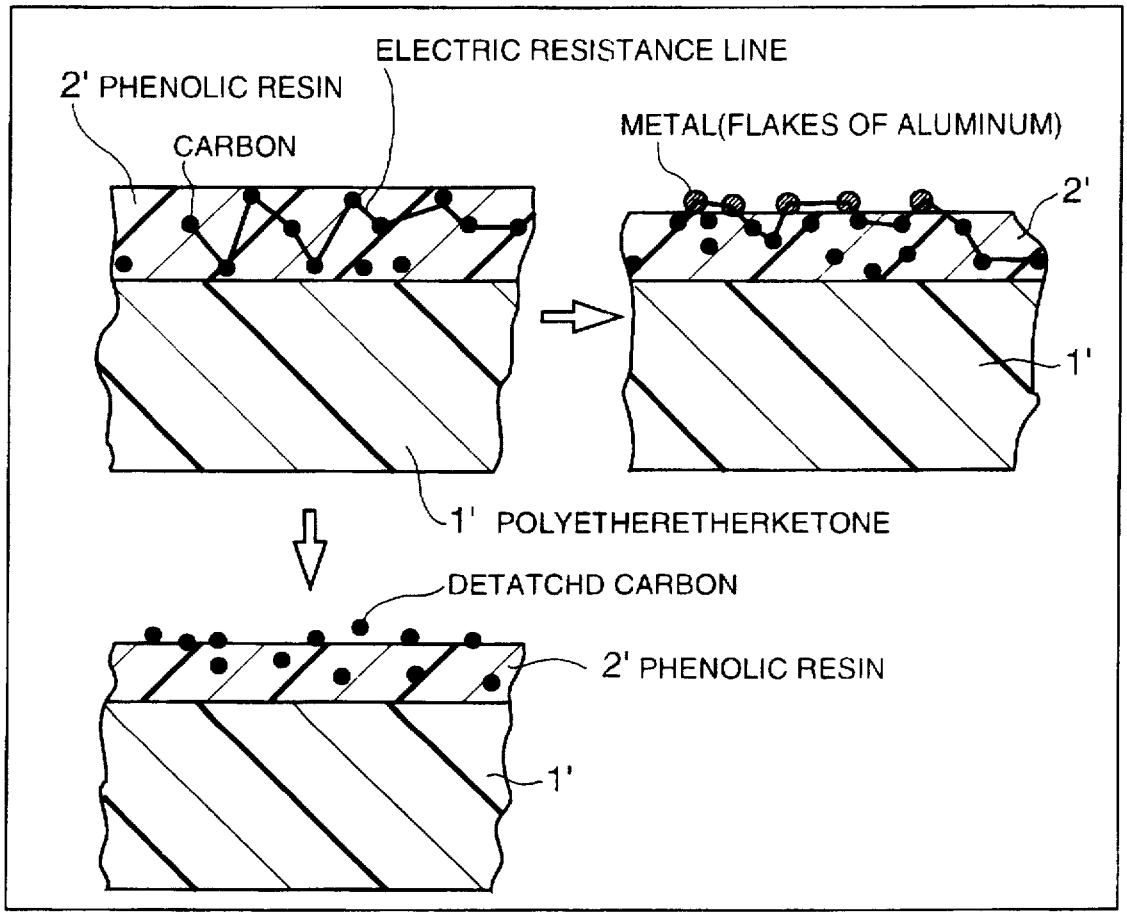
FIG. 5 (PRIOR ART)
FIG. 5 is an enlarged cross-sectional view of a portion of the bell head of FIG. 4 illustrating a principle of change in an electric resistance of the bell head of FIG. 4.

As illustrated in FIG. 2, the coating apparatus 3 includes a bell head (rotary atomizing head), generally indicated 4 for atomizing paint, a hollow drive shaft 10 to a front end of which the bell head 4 is coupled so as to rotate together with the bell head 4, an air motor 6 for rotating the drive shaft (the air motor including an air bearing for floatingly supporting the drive shaft), at least one paint feed tube extending through the hollow drive shaft 10 up to an interior of the bell head 4 and supplying paint to the bell head 4, an air cap 11 having an air nozzle for expelling air against paint, which scatters radially outwardly from an outermost edge of the bell head due to a centrifugal force, a high voltage electricity generator 7 for generating a high voltage electricity to be afforded to the scattering paint through the bell head 4, and a casing 12. The air cap 11 and the casing 12 are made from electrically high resistance material such as synthetic resins, for example, polyetheretherketone, polyether imide, polyacetal, etc.

The bell head 4 includes a bell portion, a hub, and a disk portion connecting the bell portion and the hub. The hub is located in front of the at least one paint feed tube 5 and axially opposes the at least one paint feed tube 5. A plurality holes 4a for letting paint pass therethrough during coating are formed at a radially extending outer portion of the disk portion, and a plurality of bores 4b for use in self-cleaning are formed in this hub for letting a portion of thinner to pass therethrough when the rotary atomizing head is cleaned.

The high voltage electricity generated by the high voltage electricity generator 7 is transmitted through the air motor 6 and the drive shaft 10 to the bell head 4, and the bell head 4 atomizes paint drops scattering from the outermost edge of the bell head 4, so that almost all of the paint drops reach an objective workpiece and paint loss is minimized. As a result, a high painting or coating efficiency is obtained.

Figure 1:
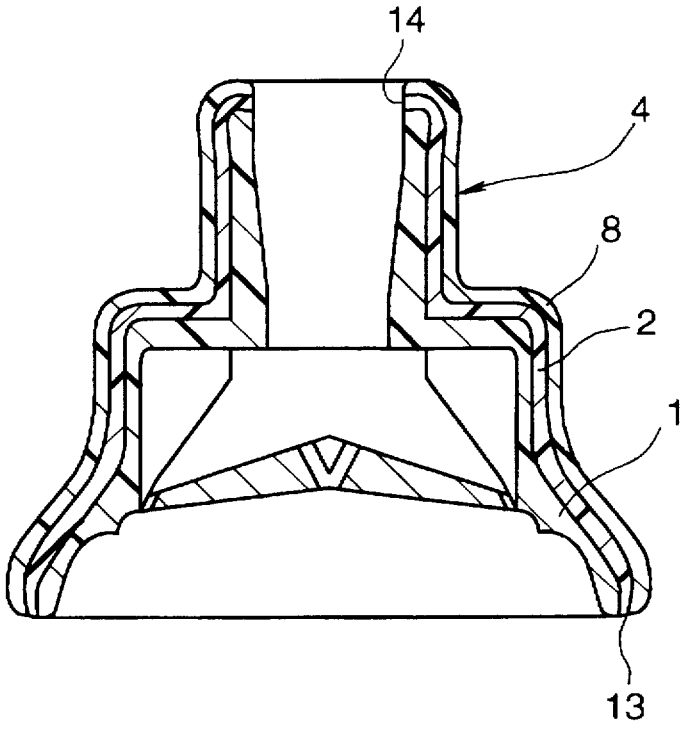
FIG. 1 is a cross-sectional view of a bell head of a rotary atomizing electrostatic coating apparatus according to one embodiment of the present invention.

As illustrated in FIG. 1, the bell head 4 includes a bell head body (main body) 1 made from electrically high resistance material (non-conductive material), a semi-conductive layer 2 formed on an entire outside surface of the bell head body 1, and a high electrical resistance layer (non-conductive layer) 8 formed on an entire outside surface of the semi-conductive layer 2. The high electrical resistance layer 8 is chemically resistant, particularly, thinner resistant so as to prevent or limit corrosion. Preferably, the semi-conductive layer 2 has an electric resistance of $10^8$ to $10^9$ Ω, and any one of the main body 1 and the non-conductive layer 8 has an electric resistance higher than the electric resistance of the semi-conductive layer 2, for example, above $10^{10}$ Ω. The semi-conductive layer 2 contacts the drive shaft 10 at one axial end of the layer 2, so that the layer 2 is electrostatically charged through the drive shaft 10. The semi-conductive layer 2 is formed by, for example, coating a semi-conductive paint on the outside surface of the bell head body 1.

The high electric resistance material (non-conductive material) of the bell head body 1 is, for example, synthetic resin. The synthetic resin includes, for example, super engineering plastic. The super engineering plastic includes either (a) thermoplastic specific engineering plastic such as polyether imide or (b) thermoplastic super engineering plastic such as polyetheretherketone. The structural formula of polyether imide and polyetheretherketone are as follows:

[polyether imide]

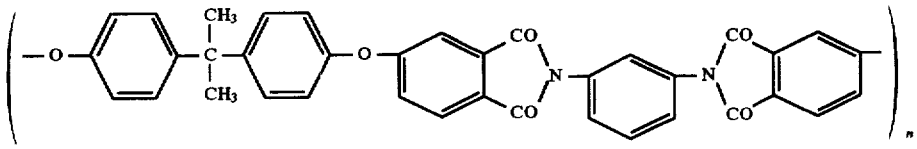

[polyetheretherketone]

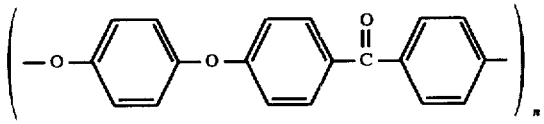

The semi-conductive material of the semi-conductive layer 2 includes, for example, either (a) phenolic resin containing a particles of electrically conductive material (for example, carbon, but not limited to carbon) therein or (b) epoxy resin containing particles of electrically conductive material (for example, carbon, but not limited to carbon) therein.

The chemical-proof and a thinner-proof material of the high electric resistance material 8 includes phenolic resin, epoxy resin, polytetrafluoroethylene, etc.

The semi-conductive layer 2 has a front end 13 and a rear end 14 which are not covered by the outermost layer 8. The front end 13 of the semi-conductive layer 2 is exposed so as to be able to electrically charge the paint, and the rear end 14 of the semi-conductive layer 2 is exposed so as to be electrically conductive with the drive shaft 10.

The high electric resistance layer 8 covers the entire outside surface of the semi-conductive layer 2 except the front end 13 and the rear end 14 of the semi-conductive layer 2.

Preferably, a thickness of the semi-conductive layer 2 is at 1 to 10 μm so that stable electrostatic coating can be conducted, and a thickness of the high electric resistance layer 8 is at 5 to 20 μm so that the layer 8 can reliably protect the semi-conductive layer 2 from chemicals and/or thinner.

The semi-conductive layer 2 keeps the electric resistance of the bell head 4 at a semi-conductive level throughout the entire outside surface of the bell head body 1. Further, the high electric resistance layer 8 of a chemical-proof and a thinner-proof type effectively protects the semi-conductive layer 2 throughout the entire outside surface of the semi-conductive layer 2 except the opposite ends the layer 2. Charging static electricity to paint drops is conducted at the exposed front end of the semi-conductive layer 2.

Since the high electric resistance layer (non-conductive layer) 8 covers the bell head 4 as the outermost layer and both of the air cap 11 and the casing 12 are also made from synthetic resin of high electric resistance, the outside surface of the rotary atomizing electrostatic coating apparatus 3 is at a high electric resistance condition so that generation of a spark between the apparatus and the objective workpiece is effectively prevented. Further, since the front end of the bell head 4 is at a semi-conductive condition, generation of a spark between the front end of the bell head and the objective workpiece is unlikely to occur.

In order that the above-described effect is stably obtained, the electric resistance of the semi-conductive layer 2 is required to be kept constant and the electric resistance of the bell head 4 is required to be kept at the semi-conductive level. In this instance, as illustrated in FIG. 3, since the high electric resistance layer 8 of a chemical-proof and a thinner-proof type is formed on the outside surface of the semi-conductive layer 2, no electric resistance line is formed between the semi-conductive layer 2 and the flakes of aluminum in the metallic paint. Thus, even when the metallic paint contacts the high electric resistance layer 8, the electric resistance of the semi-conductive layer 2 does not change. Further, since the semi-conductive layer 2 is isolated from chemicals and thinner by the high electric resistance layer 8, the semi-conductive layer 2 is protected from corrosion due to chemicals and thinner, and a change in the electric resistance of the semi-conductive layer due to the corrosion does not occur. As a result, the electric resistance of the bell head 4 is kept stably at the semi-conductive level, so that a spark is prevented. Further, charging electricity to the paint is conducted stably, so that the painting efficiency is kept high.

According to the present invention, the following technical advantages are obtained:

Since the high electric resistance layer 8 is formed on the outside surface of the semi-conductive layer 2, an electric resistance line is not formed between the semi-conductive layer 2 and the metallic paint, so that even when the metallic paint contacts the bell head 4, the electric resistance of the bell head 4 does not change. Further, since the layer 8 is of a chemical-proof and a thinner-proof type, no corrosion is caused in the semi-conductive layer 2, so that the electric resistance of the semi-conductive layer 2 does not change due to corrosion. As a result, the electric resistance of the bell head 4 is kept at a semi-conductive layer, so that no spark occurs and stable charging of the paint is assured, resulting in a high painting efficiency.

Although the present invention has been described with reference to the specific exemplary embodiment, it will be appreciated by those skilled in the art that various modifications and alterations can be made to the particular embodiment shown, without materially departing from the novel teachings and advantages of the present invention. Accordingly, it is to be understood that all such modifications and alterations are included within the spirit and scope of the present invention as defined by the following claims.

What is claimed is:

1. A bell head of a rotary atomizing electrostatic coating apparatus comprising:

a bell head body made from high electric resistance material, the bell head body having the shape of a bell having an outside surface;

a semi-conductive layer formed on said outside surface of said bell head body, said semi-conductive layer having an outside surface; and a high electric resistance layer formed on said outside surface of said semi-conductive layer, said high electric resistance layer being resistant to chemicals and thinner.

2. A bell head according to claim 1, wherein said high electric resistance material of said bell head comprises synthetic resin.

3. A bell head according to claim 2, wherein said synthetic resin is a super engineering plastic.

4. A bell head according to claim 3, wherein said super engineering plastic is polyether imide.

5. A bell head according to claim 3, wherein said super engineering plastic is polyetheretherketone.

6. A bell head according to claim 1, wherein said semi-conductive layer is made from phenolic resin containing particles of electrically conductive material therein.

7. A bell head according to claim 1, wherein said semi-conductive layer is made from epoxy resin containing particles of electrically conductive material therein.

8. A bell head according to claims 6 or 7, wherein said electrically conductive material is carbon.

9. A bell head according to claim 1, wherein said semi-conductive layer has a thickness of 1 to 10 μm.

10. A bell head according to claim 1, wherein said semi-conductive layer is formed on the entire outside surface of said bell head body.

11. A bell head according to claim 1, wherein said high electric resistance layer is made from a synthetic resin selected from the group consisting of phenolic resin, epoxy resin and polytetrafluoroethylene.

12. A bell head according to claim 1, wherein said high electric resistance layer has a thickness of 5 to 20 μm.

13. A bell head according to claim 1, wherein said semi-conductive layer has a front end and a rear end, and wherein said high electric resistance layer is formed on semi-conductive layer except at said front end and said rear end of said semi-conductive layer.

14. A bell head according to claim 1, wherein said semi-conductive layer has an electric resistance of $10^8$ to $10^9$ Ω and each of said bell head body and said high electric resistance layer has an electric resistance higher than that of said semi-conductive layer.

* * * * *